United States Patent [19]

Swartzbaugh et al.

[11] Patent Number: 4,503,985

[45] Date of Patent: Mar. 12, 1985

[54] TAMPER INDICATING PACKAGE WITH LARGE DIAMETER OPENING

[75] Inventors: Peter T. Swartzbaugh, Toledo; Edward M. Hehl, Perrysburg, both of Ohio

[73] Assignee: Owens-Illinois, Inc., Toledo, Ohio

[21] Appl. No.: 543,700

[22] Filed: Oct. 20, 1983

[51] Int. Cl.[3] ..... B65D 41/34

[52] U.S. Cl. ..... 215/252

[58] Field of Search ..... 215/252, 258

[56] References Cited

U.S. PATENT DOCUMENTS

| | | | |
|---|---|---|---|
| 3,329,295 | 7/1967 | Fields | 215/252 |
| 3,901,403 | 8/1975 | Menke | 215/258 X |
| 4,299,328 | 11/1981 | Ochs et al. | 215/252 |
| 4,322,012 | 3/1982 | Conti | 215/252 X |
| 4,333,577 | 6/1982 | Mumford | 215/252 X |
| 4,436,212 | 3/1984 | Llera | 215/258 X |

*Primary Examiner*—Donald F. Norton

*Attorney, Agent, or Firm*—John R. Nelson; Myron E. Click

[57] ABSTRACT

A tamper indicating package comprising a container having a neck finish with a large opening and threads on the exterior thereof, and an annular bead spaced axially from the threads and away from the open end of the container and a plastic closure having a top wall and a peripheral skirt formed with interrupted threads adapted to engage the threads on the container and an integral tamper indicating band on the periphery of the skirt connected thereto by an internal groove which defines a weakened line and having an interrupted radially extending bead adapted to engage the bead on the container. The bead on the tamper indicating band is interrupted along the same axial plane as the threads on the skirt so that the tamper indicating band is without a bead in substantially the same areas as the portions of the skirt are without threads.

10 Claims, 4 Drawing Figures

TAMPER INDICATING PACKAGE WITH LARGE DIAMETER OPENING

The invention relates to tamper indicating packages and particularly to such packages wherein the container has a large opening.

BACKGROUND AND SUMMARY OF THE INVENTION

In the packaging of various products, it has been common to provide a tamper indicating device to indicate whether the contents have been tampered with. In one such tamper indicating package commonly used, the container is formed with a neck having external threads that are engaged by the threads of a closure. The closure includes a tamper indicating band connected to the skirt thereof along a weakened line which has a radially inwardly extending bead adapted to engage a complementary bead on the container. When the closure is unthreaded, the tamper indicating band is broken along the weakened line to indicate that the closure has been unthreaded and the contents therefore have been made accessible.

Such a tamper indicating package has been used extensively with containers having narrow neck openings but has been found to be impractical on containers having larger openings such as 1½" or more. In the manufacture of containers having larger neck openings, manufacturing tolerances build up so that it has been difficult to produce a package which will accommodate the manufacturing tolerances and insure that the tamper indicating band will properly engage the container.

Accordingly, among the objectives of the present invention are to provide a tamper indicating package that will accommodate manufacturing tolerances in containers having large neck openings and which can be manufactured at low cost.

DESCRIPTION

Figure 1:
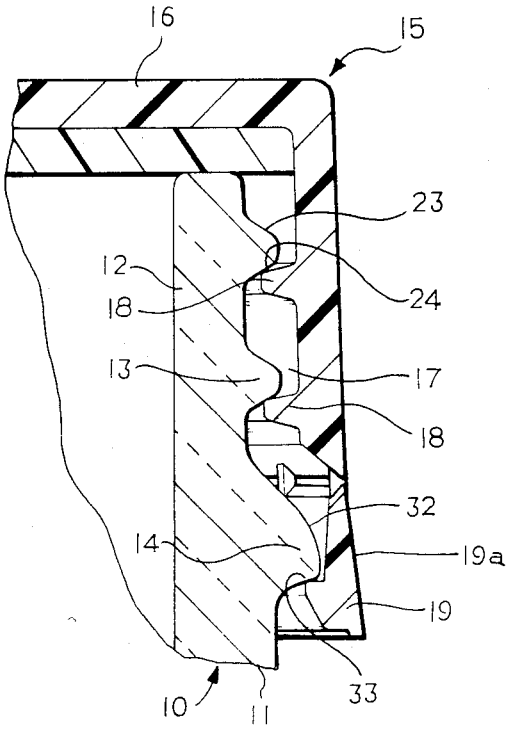
FIG. 1 is a fragmentary sectional elevational view of tamper indicating package embodying the invention.

Referring to FIG. 1, the tamper indicating package embodying the invention comprises a container 10 of glass or plastic which includes a body 11, a neck 12 and integral threads 13 on the neck. The container 10 further includes integral annular bead 14 spaced axially from the open end of the neck with respect to the threads. In accordance with the invention, the neck is such that it provides large openings on the order of 1½".

Figure 3:
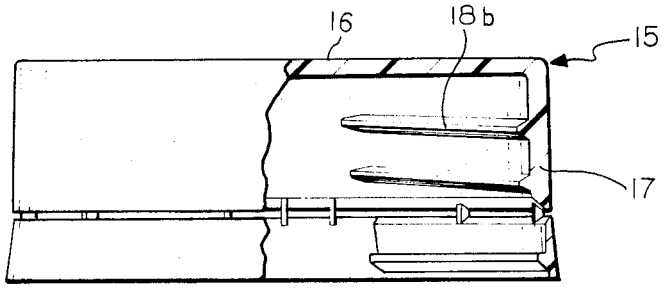
FIG. 3 is a part sectional elevational view of the closure.
Figure 4:
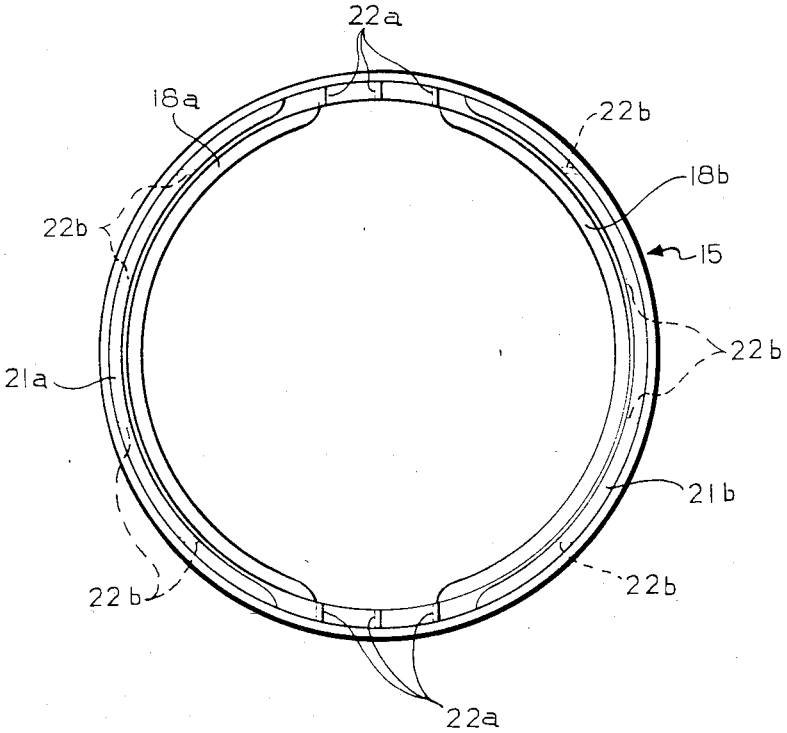
FIG. 4 is a bottom plan view of the closure.

The tamper indicating package further includes a closure 15 made of plastic such as polypropylene or high density polyethylene. The closure has a top wall 16 and a peripheral skirt 17 with internal threads 18 adapted to engage the threads on the container. The threads 18 are interrupted into thread portions **18*a*, 18*b* that are less than 180° leaving diametrically opposed portions of the skirt without threads (FIGS. 3, 4**). The portions of the threads are spaced from one another along axial planes.

The closure further includes an integral tamper indicating band 19 connected by a thin weakened portion defined by an annular internal groove. The band includes a radially inwardly extending annular bead 21 comprising spaced bead portions **21*a*, 21*b* that are diametrically opposed such that the portions of the skirt along the axial plane do not have bead portions thereon. The periphery 19*a* of the band 19** extends downwardly and outwardly from the periphery of the skirt.

Integral bridges 22 are provided at circumferentially spaced points in the groove and have a greater dimension in an axial direction than in a circumferential direction.

The bridges **22*a* in the portions without threads extend in planes generally parallel to the axial plane through the portion without thread. The bridge 22*b*** in the portions of the skirt with a thread extend generally in a plane at a right angle to the axial plane.

The threads on the container preferably include a first surface 23 which extends downwardly and radially outwardly and a second surface 24 extending from surface 23 generally axially downwardly and radially inwardly. The threads on the skirt are of a configuration which includes a first surface 25 which extends downwardly and radially inwardly and is generally planar, a second surface 26 extending from the first surface generally axially and being generally planar and a third surface 27 extending downwardly and radially outwardly and being generally planar.

Figure 2:
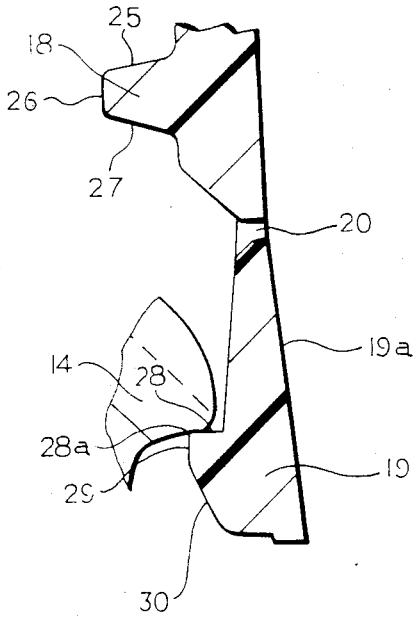
FIG. 2 is a fragmentary sectional elevational view of a portion of the package.

The annular bead portions **21*a*, 21*b* on the skirt includes a first surface 28 which is generally radial and extends radially inwardly, a second surface 29 extends axially and a third surface 30 extends downwardly and outwardly (FIG. 2**).

When the closure is threaded on the container, the inclined surface 30 on the bead portions **21*a*, 21*b* of the tamper indicating band contact the convex surface 32 of the annular bead 14 on the container and flex the band 19 outwardly so that it snaps over the annular bead 14 on the container and the radial surface 28 on the bead 21*a*, 21*b* portions of the tamper indicating band engages the annular radial surface 33** of the annular bead on the container.

Inasmuch as portions of the skirt are without threads and annular bead, the tamper indicating band can flex more readily over the large diameter of the annular bead 14 and snap over the annular bead 14 of the container. The bridge portions **22*a*, 22*b*** function to provide sufficient strength so that the tamper indicating band will not be broken away from the skirt during the application.

By providing spaced bead portions **21*a*, 21*b* on the tamper indicating band, it is possible to make the tamper indicating band bead portions 21*a*, 21*b* deeper and sharper at corner 28A** so that they will accommodate variations in the tolerances of the container. With assurance of proper separation when removal is accomplished.

When the closure is unthreaded, the force placed upon the weakened portion 20 causes the tamper indicating band to be severed along the weakened portion 20 leaving the band 19 on the container.

We claim:

1. A tamper indicating package comprising a container having a neck finish with a large opening, said neck finish having threads on the exterior thereof, said neck finish including an annular bead spaced axially from the threads and away from the opened end of the container, a plastic closure having a top wall and a peripheral skirt, said skirt being formed with threads adapted to engage the threads on the container, said threads on the closure being interrupted and extending in portions of less than 180° with respect to an axial plane through the closure such that diametrically opposed portions of the skirt are without threads, an integral tamper indicating band extending axially from the periphery of the skirt and being connected thereto by an internal groove which defines a weakened line, a plurality of circumferentially spaced integral bridges spanning portions of the internal groove, said tamper indicating band having an outer peripheral surface that is inclined downwardly and outwardly from the skirt, said tamper indicating band having an interrupted radially extending bead adapted to engage the bead on the container, said bead on the container having a downwardly and outwardly inclined peripheral surface extending axially downwardly and outwardly and an inwardly extending substantially flat radial surface extending from the extremity of said inclined surface, said bead on the tamper indicating band being interrupted along the same axial plane as said threads on the skirt so that the tamper indicating band is without a bead in substantially the same areas as the portions of the skirt are without threads such that when the closure is threaded on a container, the bead on the tamper indicating band will move downwardly on the inclined surface of the annular bead on the container and flex and snap over the bead on the container into engagement with the radial surface of the annular bead on the container and when the closure is unthreaded from the container, the tamper indicating band will be broken along the weak line.

2. The tamper indicating package set forth in claim 1 wherein said integral bridges in the portions of the internal groove which are in the area of the skirt without threads lie in planes parallel to the axial plane and the bridges in the portions of the internal groove where the skirt has thread portions lie in planes at a right angle to the axial plane.

3. The tamper indicating package set forth in claim 2 wherein said bridges have a greater dimension in the axial direction than the circumferential direction.

4. The tamper indicating package set forth in claim 1 wherein said threads on the container each include a first portion extending downwardly and outwardly from the open end of the container and a second portion extending downwardly and radially inwardly from the extremity of the first portion.

5. The tamper indicating package set forth in claim 4 wherein said threads on the closure each comprise a first surface extending axially downwardly and radially outwardly from the top wall and being generally planar, a second surface connecting first surface and being generally axial and a third surface connected to the second portion and extending axially downwardly and radially inwardly from the top wall and being generally planar.

6. The tamper indicating package set forth in claim 1 wherein the inclined surface of the annular bead of the container is convex.

7. The tamper indicating closure for a container having a neck finish with a large opening, said neck finish having threads on the exterior thereof, said neck finish including an annular bead spaced axially from the threads and away from the opened end of the container comprising a plastic closure having a top wall and a peripheral skirt, said skirt being formed with threads adapted to engage the threads on the container, said threads on the closure being interrupted and extending in portions of less than 180° with respect to an axial plane through the closure such that diametrically opposed portions of the skirt are without threads, an integral tamper indicating band extending axially from the periphery of the skirt and being connected thereto by an internal groove which defines a weakened line, a plurality of circumferentially spaced integral bridges spanning portions of the internal groove, said tamper indicating band having an outer peripheral surface that is inclined downwardly and outwardly from the skirt, said tamper indicating band having an interrupted radially extending bead adapted to engage the bead on the container, said bead on the tamper indicating band being interrupted along the same axial plane as said threads on the skirt so that the tamper indicating band is without a bead in substantially the same area as the portions of the skirt are without a thread such that when the closure is threaded on a container, the bead on the tamper indicating band will move downwardly on the inclined surface of the annular bead on the container and flex and snap over the bead on the container into engagement with the radial surface of the annular bead on the container and when the closure is unthreaded from the container, the tamper indicating band will be broken along the weak line.

8. The tamper indicating package set forth in claim 7 wherein said integral bridges in the portions of the internal groove which are in the area of the skirt without threads lie in planes parallel to the axial plane and the bridges in the portions of the internal groove where the skirt has thread portions lie in planes at a right angle to the axial plane.

9. The tamper indicating package set forth in claim 8 wherein said bridges have a greater dimension in the axial direction than in the circumferential direction.

10. The tamper indicating package set forth in claim 7 wherein said threads on the closure each comprise a first surface extending axially downwardly and radially outwardly from the top wall and being generally planar, a second surface connecting first surface and being generally axial and a third surface connected to the second portion and extending axially downwardly and radially inwardly from the top wall and being generally planar.

* * * * *